US006438243B1

(12) United States Patent
Ikeuchi et al.

(10) Patent No.: US 6,438,243 B1
(45) Date of Patent: Aug. 20, 2002

(54) VIBRATION WAVE DETECTOR

(75) Inventors: Naoki Ikeuchi; Muneo Harada; Shoichi Fukui; Takahiko Oasa, all of Osaka; Shigeru Ando; Kenji Tanaka, both of Chiba, all of (JP)

(73) Assignee: Sumitomo Metal Industries Ltd., Osaka (JP)

( * ) Notice: Subject to any disclaimer, the term of this patent is extended or adjusted under 35 U.S.C. 154(b) by 0 days.

(21) Appl. No.: 09/085,047

(22) Filed: May 27, 1998

(30) Foreign Application Priority Data

Nov. 28, 1997 (JP) ..... 9-328961

(51) Int. Cl.[7] ..... H04R 25/00

(52) U.S. Cl. ..... 381/191; 381/174; 381/178; 367/189; 367/181; 73/862.59

(58) Field of Search ..... 381/162, 174, 381/178, 191, 338, 339; 367/181, 189; 73/862.59

(56) References Cited

U.S. PATENT DOCUMENTS 4,302,634 A * 11/1981 Paglia ..... 381/174
4,739,664 A * 4/1988 Hetrick ..... 73/704
4,751,849 A * 6/1988 Paros et al. ..... 73/862.59
5,036,715 A * 8/1991 Hanson ..... 73/862.59
5,307,311 A * 4/1994 Silwa, Jr. ..... 365/174
5,834,646 A * 11/1998 Kvisteroy et al. ..... 73/862.59
5,856,722 A 1/1999 Haronian et al. ..... 310/321

OTHER PUBLICATIONS

IEEE Signal Processing Magazine, pp. 45–47; Sep. 1996. (See page 1 of the specification).

S. Nakagawa et al.; Neuro Science & Technology Series Speech Auditory and Neuro Circuit Network Model; pp. 116–125, Aug. 25, 1990. (See page 2 of the specification).

S. Nakagawa et al.; Neuro Science & Technology Series Speech Auditory and Neuro Circuit Network Model; pp. 162–171, Aug. 25, 1990. (See page 4 of the specification).

* cited by examiner

*Primary Examiner*—Curtis A. Kuntz
*Assistant Examiner*—Suhan Ni
(74) *Attorney, Agent, or Firm*—Armstrong, Westerman & Hattori, LLP.

(57) ABSTRACT

A vibration wave detector having a first diaphragm for receiving vibration waves, such as sound waves and so on, to be propagated in a medium, a resonant unit having a plurality of cantilever resonators each having such a length as to resonate at an individual predetermined frequency, a retaining rod for retaining the resonant unit, a second diaphragm positioned on the opposite side of the first diaphragm with respect to the retaining rod, and a vibration intensity detector for detecting the vibration intensity, for each predetermined frequency, of each of the resonators, by the vibration waves received by the first diaphragm and propagated to the resonant unit through the retaining rod.

23 Claims, 14 Drawing Sheets

FIG. 2
PRIOR ART

| BAND NUMBER [BARK] | CENTRAL FREQUENCY [Hz] | CUTOFF FREQUENCY [Hz] | CRITICAL BAND WIDTH [Hz] |
|---|---|---|---|
| | | 20 | |
| 1 | 50 | 100 | 80 |
| 2 | 150 | 200 | 100 |
| 3 | 250 | 300 | 100 |
| 4 | 350 | 400 | 100 |
| 5 | 450 | 510 | 110 |
| 6 | 570 | 630 | 120 |
| 7 | 700 | 770 | 140 |
| 8 | 840 | 920 | 150 |
| 9 | 1000 | 1080 | 160 |
| 10 | 1170 | 1270 | 190 |
| 11 | 1370 | 1480 | 210 |
| 12 | 1600 | 1720 | 240 |
| 13 | 1850 | 2000 | 280 |
| 14 | 2150 | 2320 | 320 |
| 15 | 2500 | 2700 | 380 |
| 16 | 2900 | 3150 | 450 |
| 17 | 3400 | 3700 | 550 |
| 18 | 4000 | 4400 | 700 |
| 19 | 4800 | 5300 | 900 |
| 20 | 5800 | 6400 | 1100 |
| 21 | 7000 | 7700 | 1300 |
| 22 | 8500 | 9500 | 1800 |
| 23 | 10500 | 12000 | 2500 |
| 24 | 13500 | 15500 | 3500 |

VIBRATION WAVE DETECTOR

BACKGROUND OF THE INVENTION

1. Field of the Invention

The present invention relates to a vibration wave detector for detecting the characteristics of the vibration waves, such as an example of sound waves, to be propagated in a medium.

2. Description of the Prior Art

In the conventional system tor executing speech recognition, vibrations of a microphone which received speech signals are converted-amplified into electric signals by an amplifier, and then, the analog signals are converted into digital signals by an A/D convertor to obtain speech digital signals. Fast Fourier transform is applied to the speech digital signals by a software on a computer, so as to extract the features of the speech. Such a speech recognition system as described above is disclosed in IEEE Signal Processing Magazine, Vol. 13, No. 5, pp. 45–57 (1996).

In order to extract the features of the speech signals with better efficiency, it is necessary to calculate acoustic spectra within a time period when the speech signals are considered stationary. The speech signal is normally considered stationary within the time period of 10 through 20 msec. Therefore, signal processing such as Fast Fourier transform or the like is conducted, by the software on the computer, on the speech digital signals included within the time period with 10 through 20 msec as a period.

In the conventional speech recognizing method as described above, the speech signals including the entire instantaneous zones are converted into electric signals by a microphone. To analyze the spectra of the electric signals, the A/D conversion makes the frequencies digital. The speech digital signal data are compared with the predetermined speech wave data to extract the features of the speech.

Auditory mechanism and sound psychological physical properties are described in detail by Ohm Company Co., 1992 1, in "Neuro Science & Technology Series Speech Auditory and Neuro Circuit Network Model" (pp.116–125) written by Seiichi Nakagawa, Kiyohiro Shikano, Youichi Toukura under the supervision of Shunichi Amari. This literature shows that the measure of the sound pitch audible by human beings corresponds linearly to the measure of a mel scale, instead of corresponding to linearly to frequency as physical value. The mel scale, a psychological attribute (psychological measure) representing the pitch of the sound indicated by a scale, is a scale where the intervals of the frequencies called pitches can be heard equal in interval by human beings are directly numerated. The pitch of the sound of 1000 Hz, 40 phon is defined 1000 mel. An acoustic signal of 500 mel can be heard as a sound of 0.5 time pitch. An acoustic signal of 2000 mel can be heard as the sound of twice pitches. The mel scale can be approximated as in the following (1) equation by using the frequency f [Hz] as the physical value. Also, the relationship between the sound pitch [mel] and the frequency [Hz] in the approximate equation is shown in FIG. 1.

$$\text{mel}=(1000/\log 2)\log(f/1000+1) \tag{1}$$

In order to extract the features of the speech with better efficiency, it is often conducted to convert the frequency bands of the acoustic spectra into such mel scales. The conversion, into the mel scale, of the acoustic spectra is normally carried out by the software on the computer as in the analysis of the spectra.

Also, as a method of extracting the features of the speech with better efficiency, it is often conducted to convert the frequency bands of the acoustic spectra into a Bark scale. The Bark scale is a measure corresponding to the loudness of the psychological sound of the human being. In sounds of a certain degree or larger, the Bark scale shows the frequency band width (is called critical band width) audible by human beings, and sounds within the critical band width, even if they are different, can be heard the same. When, for example, large noises occur within the critical hand width, the scale showing the frequency band wherein the signal sounds and its noises, despite different frequencies, cannot be judged with human auditory system, is the Bark scale.

In a field of the speech signal processing, the critical band width to handle easily on the computer is demanded, and consequently the frequency axis of the acoustic spectra is shown in a Bark scale where one critical hand is defined as to one Bark. FIG. 2 shows the numerical value relationship between the critical hand width and the Bark scale. The critical band width and the Bark scale can be approximated as in the following (2) and (3) equations, using the frequency f [kHz] as a physical value.

$$\text{Critical Band Width: CB[Hz]}=25+75(1+1.4f^2)^{0.69} \tag{2}$$

$$\text{Bark Scale: B[Bark]}=13\tan^{-1}(0.76f)+3.5\tan^{-1}(f/7.5) \tag{3}$$

It is known to use an engineering functional model of acoustic peripheral system in the speech recognition field, and the conception of the model is described in detail in the Literature "Neuro Science & Technology Series Speech Auditory and Neuro Circuit Network Model" (pp.162–171). In the engineering functional model, frequency spectra analysis is preprocessed by band width filter groups. In, for example, the preprocessing at a Seneff model which is one of the representative engineering functional model, the frequency spectra analysis is conduced by critical band width filter groups having forty independent channels in the frequency range of 130 through 6400 Hz. At that time, the frequency band of the acoustic spectra is converted into the Bark scale.

The conversion into the Bark scale can be normally conducted by the software on the computer as in the other analysis of the spectra.

In the conventional method of conducting Fast Fourier transform on the digital acoustic signal, by the software on the computer, to analyze the spectra of the acoustic signal, the calculation amount becomes immense so that the calculating load becomes bigger.

In the conventional methods, there are not problems in the speech where the acoustic spectra does not change as time passes, like only vowel sounds. But a language is made up of consonant sounds and vowel sounds. When a consonant sound comes for a first time, and a vowel sound comes for a second time like Japanese, in general, the stress of the vowel sound becomes larger as time passes. And English is made up of complicated consonant sounds and vowel sounds.

In these cases, conventionally, it was difficult to judge when the sounds were changed from consonant sounds to the vowel sounds, because the speech was recorded instantaneously, the acoustic spectra of the entire hand were integrated through division for each constant time for analyzing of the speech. Therefore, the judging ratio of the speech recognition was reduced. In order to solve the problems, much more speech patterns are stored in advance in the computer and are applied into either of these speech patterns, thereby increasing calculation load more.

BRIEF SUMMARY OF THE INVENTION

One object of the present invention is to provide a vibration wave detector which is capable of quickly and correctly conducting the frequency spectra analysis of the vibration waves on one hardware.

Other object of this invention is to provide a vibration wave detector which is capable of conducting the precise frequency spectra analysis from the high frequency side to the low frequency side.

Still other object of this invention is to provide a sound wave detector apparatus which is capable of quickly and correctly conducting the acoustic signal detection and the frequency spectra analysis on one hardware.

A vibration detector of this invention comprises a first diaphragm for receiving vibration waves to be propagated in a medium, a resonant unit having a plurality of cantilever resonators each having such a length as to resonate at an individual predetermined frequency, a retaining rod for retaining the resonant unit, a second diaphragm positioned on the opposite side of the first diagram with respect to the retaining rod, and a vibration intensity detector for detecting the vibration intensity, for each predetermined frequency, of each of the resonators.

In the above described configuration, a plurality of resonators are positioned so that resonant frequencies become sequentially lower from the first diaphragm side to the second diaphragm side.

Other vibration wave detector of this invention comprises a diaphragm for receiving vibration waves to be propagated in a medium, a resonant unit having a plurality of cantilever resonators each having such a length as to resonate at an individual predetermined frequency, a retaining rod for retaining the resonant unit, and a vibration intensity detector for detecting the vibration intensity, for each predetermined frequency, of each of the resonators, the plurality of resonators being positioned so that the resonant frequencies become sequentially lower from the near position side of the diaphragm to the far position side thereof.

In the vibration wave detector of this invention having such a configuration, the width of the retaining rod becomes narrower as it becomes further away from the first diaphragm.

The vibration wave detector of this invention has a plurality of resonators each being different in length to resonate at the predetermined frequency, transmits the vibration waves, such as sound waves, propagated in the medium to these resonators through the first diaphragm and the retaining rod, and detects the vibrations at the resonators by the vibration intensity detector. The vibration waves propagated in the medium are received by the first diaphragm, the vibration waves propagate into the retaining rod, the energy of a predetermined frequency component of the propagated vibration waves is absorbed by the cantilever resonator whose resonant frequency is almost equal to the predetermined frequency component, whereby the resonator resonates. Thus, the vibrations in the resonators are detected so that the level of each predetermined frequency component of the vibration waves propagated in the medium can be detected.

When the vibration waves are inputted without the second diaphragm, the resonant amplitude of the resonator close to the tip end (the opposite side of the input side) of the retaining rod is lowered as compared with the other resonators and the sensitivity is often lowered. When the second diaphragm is provided, resonant amplitudes of all resonators are approximately equal. On further investigation, when the inputted sound waves are provided only within the frequency hand of each resonator, it is often found out that characteristics about accuracy of resonant amplitude and sensitivity even in the absence of the second diaphragm are almost equal to those in the existence of the second diaphragm. This facts indicates that all the predetermined frequency components of the sound waves inputted from the first diaphragm are not always absorbed in a plurality of resonators. Namely, the frequency components which are not absorbed without corresponding to the resonant conditions are propagated up to the tip end (the opposite side of the input side) of the retaining rod and are reflected there. As the result, the reflected frequency components become noises, thereby to deteriorate the detection characteristic. For example, when the sounds (for example, heavy, low sounds) outside the frequency bands of a plurality of resonators are inputted, reflections occur, because of absence of a portion for absorbing energy of the frequency components, and waves interfere with each resonator, whereby noises become larger. In this invention, the second diaphragm is provided in the tip end of the retaining rod to control the reflection, whereby the unnecessary frequency components which have been propagated to the retaining rod are absorbed by the second diaphragm. In order to reduce the noises and detect the level of each frequency component precisely, resonant amplitudes from the resonators close to the input side to the far resonators are able to be make almost equal, the sensitivity on the wide frequency band is improved, and the reflections of the wave sounds outside the frequency band of the resonators are prevented. Also, stress in the end portion of the retaining rod can be relieved by attaching the first and the second diaphragms at the ends portions of the retaining rod.

In a vibration wave detector wherein the first diaphragm is made an input terminal of the vibration waves and the second diaphragm is made the absorbing end of the vibration waves, after the level detecting tests of the frequency components are repeated, it is found out that vibration energy is not propagated with better efficiency without inputting the sound waves from the high frequency side about a plurality of resonators, and the vibration energy is hardly propagated when the sound waves from the low frequency side are inputted. Namely, when the vibration waves are inputted from the high frequency side, the vibration energy is sequentially absorbed with better efficiency in each of the resonators. But when the vibration waves are inputted from the low frequency side, the vibration energy is not propagated up to an resonator corresponding to higher resonant frequency, so that the levels of higher frequency components cannot be detected precisely. In the vibration wave detector of this invention, a resonator corresponding to each higher resonant frequency is positioned on the side of the first diaphragm and a resonator corresponding to each lower resonant frequency is positioned on the side of the second diaphragm, namely, a resonator is positioned so that a resonant frequency tends to rise toward the first diaphragm side, or toward the inputting terminal of the vibration. By positioning a plurality of resonators in this way, precise detection results can be obtained about all the components from the high frequency component to the low frequency component.

When a retaining rod where the vibration waves are propagated from the first diaphragm is constant in width, the vibration energy is not propagated with better efficiency. In the vibration wave detector of this invention, the width of the retaining rod becomes gradually narrower as it goes far away from the first diaphragm side which is an input side. Since the vibration energy is propagated with better efficiency to a plurality of resonators by such a constitution of the retaining rod, the precise detection results can be obtained.

In the sound wave detector of this invention where the vibration waves are sound waves, the acoustic spectra can be obtained at real time without analytic processing, because the intensity of the sound can be detected for each of the desired frequencies. As compared with the conventional system of inputting the acoustic signals of the entire band to electrically filter to each frequency band, the present invention of mechanically analyzing the acoustic signals in this way for each of the frequencies becomes faster in processing, because the electric filtering is unnecessary.

The above and further objects and features of the invention will more fully be apparent from the following detailed description with accompanying drawings.

BRIEF DESCRIPTION OF THE SEVERAL VIEWS OF THE DRAWINGS

FIG. 2 is a table showing the numerical value relationship between the critical band width and the Bark scale;

DETAILED DESCRIPTION OF THE INVENTION

The present invention will be concretely described according to the drawings of the embodiments. A sound wave detector where the vibration waves of a detection object to be propagated in a medium are sound waves will be described hereinafter by way of embodiments.

(First Embodiment)

Figure 3:
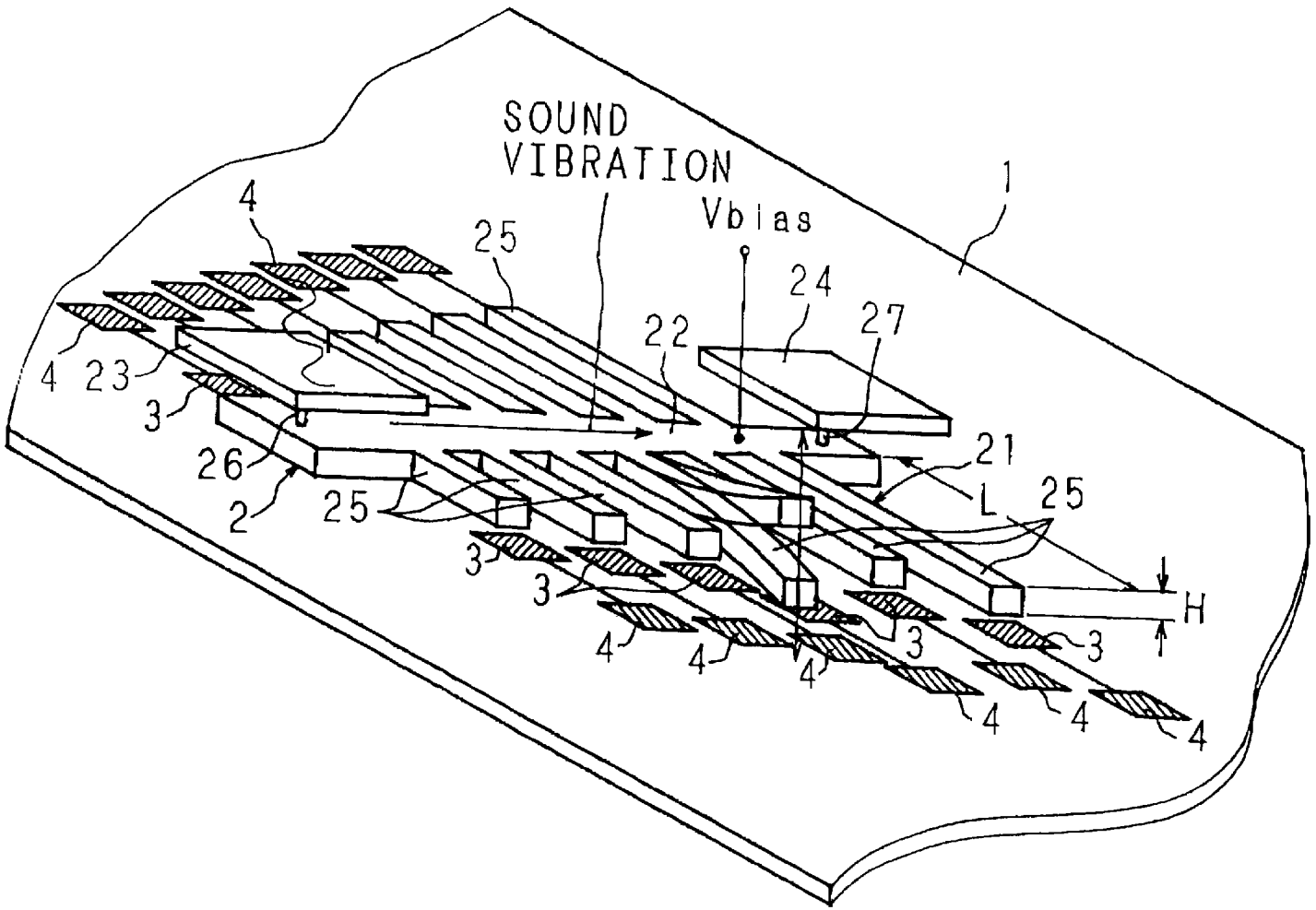
FIG. 3 is a view showing a first embodiment of a sound wave detector of this invention.
Figure 4:
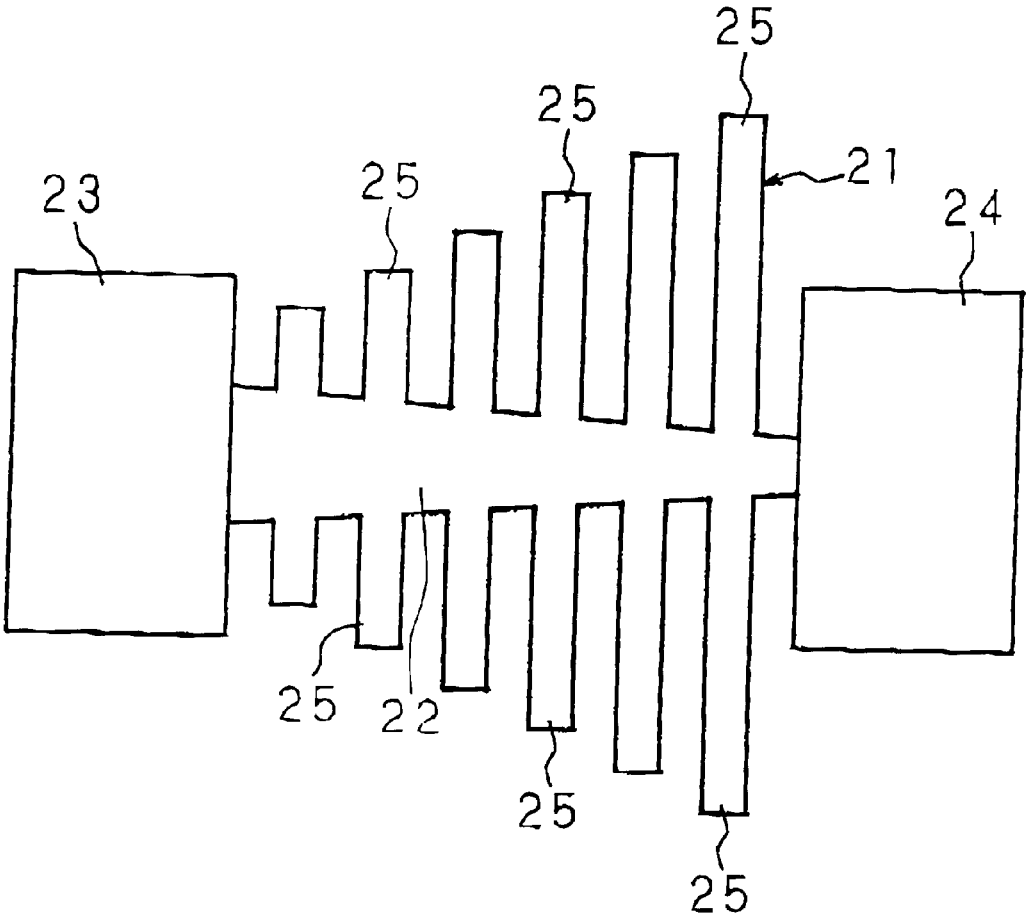
FIG. 4 is a plane view of a sensor main body of the sound wave detector (the first embodiment) of this invention.

FIG. 3 is a view showing a first embodiment of a sound wave detector of this invention. FIG. 4 is a plane view of a sensor main body to be described later. The sound wave detector of this invention is composed of a sensor main body 2, electrodes 3, and detecting circuits 4 as peripheral circuits, which are formed on a silicon substrate 1 of semiconductor. The sensor main body 2, all the portions of which are formed of semiconductor silicon, comprises a resonant unit 21 having a plurality (twelve in this embodiment) of cantilever portions each being different in length, a plate-shaped retaining rod 22 retaining the resonant unit 21 on the stationary end side of the resonance, a short rod-shaped propagating portion 26 attached to one end of the retaining rod 22, a plate-shaped first diaphragm 23 connected with the propagating portion 26 to receive the sound waves propagated in air, a short rod-shaped propagating portion 27 attached to the other end of the retaining rod 22, and a plate-shaped second diaphragm 24 connected with the propagating portion 27 to absorb unnecessary frequency components propagated into the retaining rod 22.

The retaining rod 22 is the thickest in width at close place to the first diaphragm 23, becomes gradually narrower as it goes towards the second diaphragm 21, and the narrowest at close place to the second diaphragm 24.

The resonant unit 21 is a comb teeth-shaped, and respective cantilevers which are comb teeth-shaped portions are resonators 25 each being adjusted in length to resonate at the predetermined frequency. The plurality of resonators 25 are adapted to selectively vibrate in accordance with the resonant frequency f to be represented in the following (4) equation.

$$f=(CHE^{1/2})/(L^2\rho^{1/2}) \quad (4)$$

wherein

C: constant to be determined experimentally

H: thickness of each resonator

L: length of each resonator

E: Young's modulus of material (semiconductor silicon)

ρ: density of material (semiconductor silicon)

As clear from the above (4) equation, the resonant frequency f can be set to a desired value by changing the thickness H or the length L of the resonator 25 so that each resonator 25 may have the natural resonant frequency. A pair of resonators 25 and 25 which are connected with the same position in the longitudinal direction of the retaining rod 22 have the same resonant frequency. The thickness H of all the resonators 25 is made constant and the length L becomes sequentially longer toward the right side (second diaphragm 24 side) from the left side (first diagram 23 side). The resonant frequency wherein each resonator 25 vibrates naturally is set from high-frequency to low-frequency toward the right side (second diaphragm 24 side) from the left side (first diagram 23 side). Concretely, the frequencies of resonators 25 correspond to the range of approximately 15 Hz through 20 kHz in audible band, from high-frequency to low-frequency, from the left side (first diaphragm 23 side) to the right side (second diagram 24 side). In this embodiment, a resonator 25 corresponding to each higher resonant frequency is positioned on the side of the first diaphragm 23 and a resonator 25 corresponding to each lower resonant frequency is positioned on the side of the second diaphragm 24, namely, a resonator 25 is positioned so that a resonant frequency tends to rise toward the first diaphragm 23 side, or toward the inputting terminal of the vibration.

The sensor main body 2 of such a configuration as described above is made on the silicon substrate 1 of semiconductor by using a manufacturing art of an integrated circuit or a micromachine. In such a configuration, when the sound waves are propagated to the first diaphragm 23, the plate-shaped first diaphragm 23 is vibrated, the vibrations showing the sound waves are propagated to the retaining rod 22 through the propagating portion 26, and are transmitted from the left of FIG. 3 to the right while each resonator 2,5 of the resonant unit 21 retained thereby resonates at the individual predetermined frequency.

A proper bias voltage $V_{bias}$ applied upon the sensor main body 2. A capacitor is composed of a tip end portion of each resonator 25 of the resonant unit 21 and each electrode 3 formed on the silicon substrate 1 of semiconductor and positioned opposite to the tip end portion. The tip end portion of the resonator 25 is a movable electrode which moves vertically in that position through the vibration of the resonator 25, while the electrode 3 formed on the silicon substrate 1 of semiconductor is a stationary electrode which does not move in that position. When the resonator 25 vibrates at the individual predetermined frequency, the capacity of the capacitor is adapted to change, because the distance between the movable electrode and the stationary electrode 3 changes.

Figure 5:
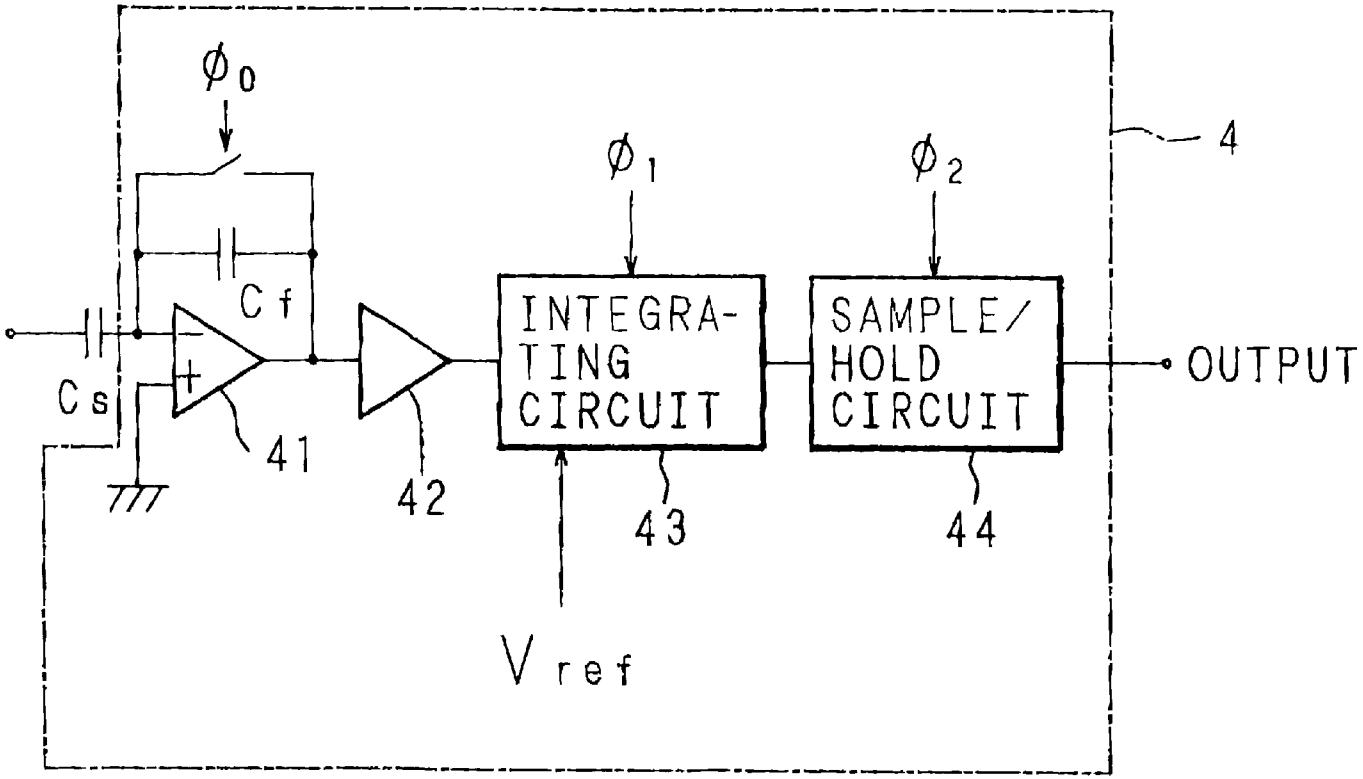
FIG. 5 is a diagram showing a configuration of a detecting circuit in the sound wave detector of this invention.

Each of the electrodes 3 is connected with a detecting circuit 4 which converts such capacity change into the voltage signals, integrates the converted voltage signals within a predetermined time period and outputs. FIG. 5 is a diagram showing the configuration of the detecting circuit 4. The detecting circuit 4 comprises operational amplifiers 41 and 42 which amplify a voltage at an amplifying ratio corresponding to an impedance ratio between the capacitor capacity $C_s$ and the reference capacity $C_f$, an integrating circuit 43 for integrating the output signals of the operational amplifier 42 higher than the reference voltage $V_{ref}$ during the predetermined time period, and a sample/hold circuit 44 for taking out the output signals from the integrating circuit 43, retaining them temporarily and outputting them. The detecting circuit 4 of such a configuration is formed of, for example, a CMOS process.

Clock pulses $\phi_0$, $\phi_1$, and $\phi_2$ are fed respectively to the operational amplifier 41, the integrating circuit 43 and the sample/hold circuit 44. The operational amplifier 41, the integrating circuit 43 and the sample/hold circuit 44 respectively operate in synchronous relation with these clock pulses. These clock pulses can be fed externally. Or a counter circuit can be formed on the same silicon substrate 1 of semiconductor so that the pulses can be fed from the circuit.

The operation will be described hereinafter. When the sound waves propagated in air are propagated to the first diaphragm 23 of the sensor main body 2, the plate-shaped first diaphragm 23 is vibrated to propagate the vibrations into the sensor main body 2. In this case, the sound waves from the left to the right of FIG. 3 are transmitted, vibrating each resonator 25 of the cantilever which becomes sequentially longer (resonant frequency becomes sequentially lower). Each resonator 25 has a natural resonant frequency and resonates when the sound waves of the natural frequency are propagated and vibrated so that the tip end portion vibrates vertically. The vibrations change the capacity of the capacitor to be composed between the tip end portion and the electrode 3.

The frequency components which are not absorbed by any resonators 25 are propagated to the second diaphragm 24 so that they are absorbed by it. Thus, the reflection waves which are accompanied by the unnecessary frequency components are not caused. As the result, without a likelihood of influences upon the capacity changes by the reflection waves, the correct capacity changes which correspond to the spectra of the propagated sound waves can be detected.

Figure 6:
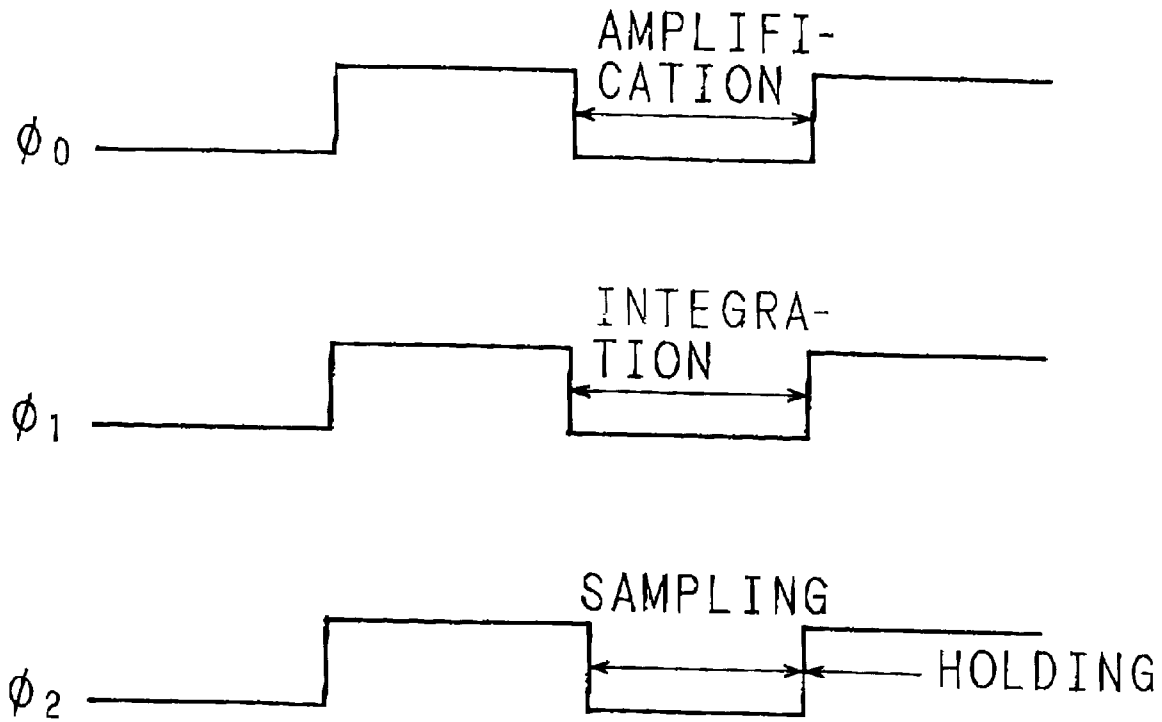
FIG. 6 is a diagram showing a timing chart of the detecting circuit in the sound wave detector of this invention.

The obtained capacity changes are fed into the detecting circuit 4. FIG. 6 is a diagram showing a timing chart within the detecting circuit 4, showing the clock pulses $\phi_0$, $\phi_1$ and $\phi_2$ fed respectively to the operational amplifier 41, the integrating circuit 43 and the sample/hold circuit 44. The clock pulse controlling in this embodiment is ON condition at the low level.

Within the detecting circuit 4 is determined an amplifying ratio in accordance with the impedance ratio between the capacity $C_s$ of the capacitor obtained by the operational amplifier 41 and the reference capacity $C_f$. For example, when the value of $1/\omega C_s$ to $I/\omega C_f$($\omega=2\pi f$, f: frequency) is 1/2, the voltage signal to be obtained becomes twice. Since the operational amplifiers 41 and 12 are also inverters where the + input terminal is grounded, the voltage phase is inverted one time by the next stage of operational amplifier 42. The obtained amplified voltage signals are inputted to the integrating circuit 43. In the integrating circuit 43, the amplified voltage signals which are higher than the reference voltage $V_{ref}$ are integrated within the predetermined time period corresponding to the clock pulse $\phi_1$ and the integrated signal is inputted into the sample/hold circuit 44. In the sample/hold circuit 44, the sampling and holding of the integrated signal is repeated in accordance with the clock pulse $\phi_2$, and the integrated signal is externally outputted.

The above described processing is conducted in parallel for each of the detecting circuits 4, corresponding respectively to the resonators 25 each being different in length. A period of the clock pulses $\phi_0$, $\phi_0$, and $\phi_2$ shown in FIG. 6 is one example. It is needless to say that a period of each clock pulse can be set optionally.

By the investigation of the output signal of the detecting circuit 4 corresponding to the resonator 25 to resonate at the individual predetermined frequency in this invention, the lapse change of the intensity of the sound of the predetermined frequency with an optional time being a period can be known. By the investigation of the output signals of the detecting circuits 4 corresponding to a plurality of resonators 25, the lapse change of the intensity of the sound for each of a plurality of the frequency bands with an optional time being a period can be known. In this case, the integrated results can be outputted for one predetermined frequency, or the integrated results can be outputted for each of a plurality of specific frequencies.

The acoustic data is complete even in division for each constant time period. Since the acoustic data of each of the frequencies can be obtained for each constant time period, the passage of the intensity of each frequency can he confirmed in accordance with the passage of time, and the judging ratio of the speech recognition can be improved by correctly judging the time change, for example, between vowel sounds and consonant sounds. Since the acoustic data for each of frequencies can be obtained for each constant time period, the passage of the intensity of each frequency in accordance with the passage of the time period, and the judging ratio of the speech recognition can be improved by correctly judging the time change of the speech.

Figure 7:
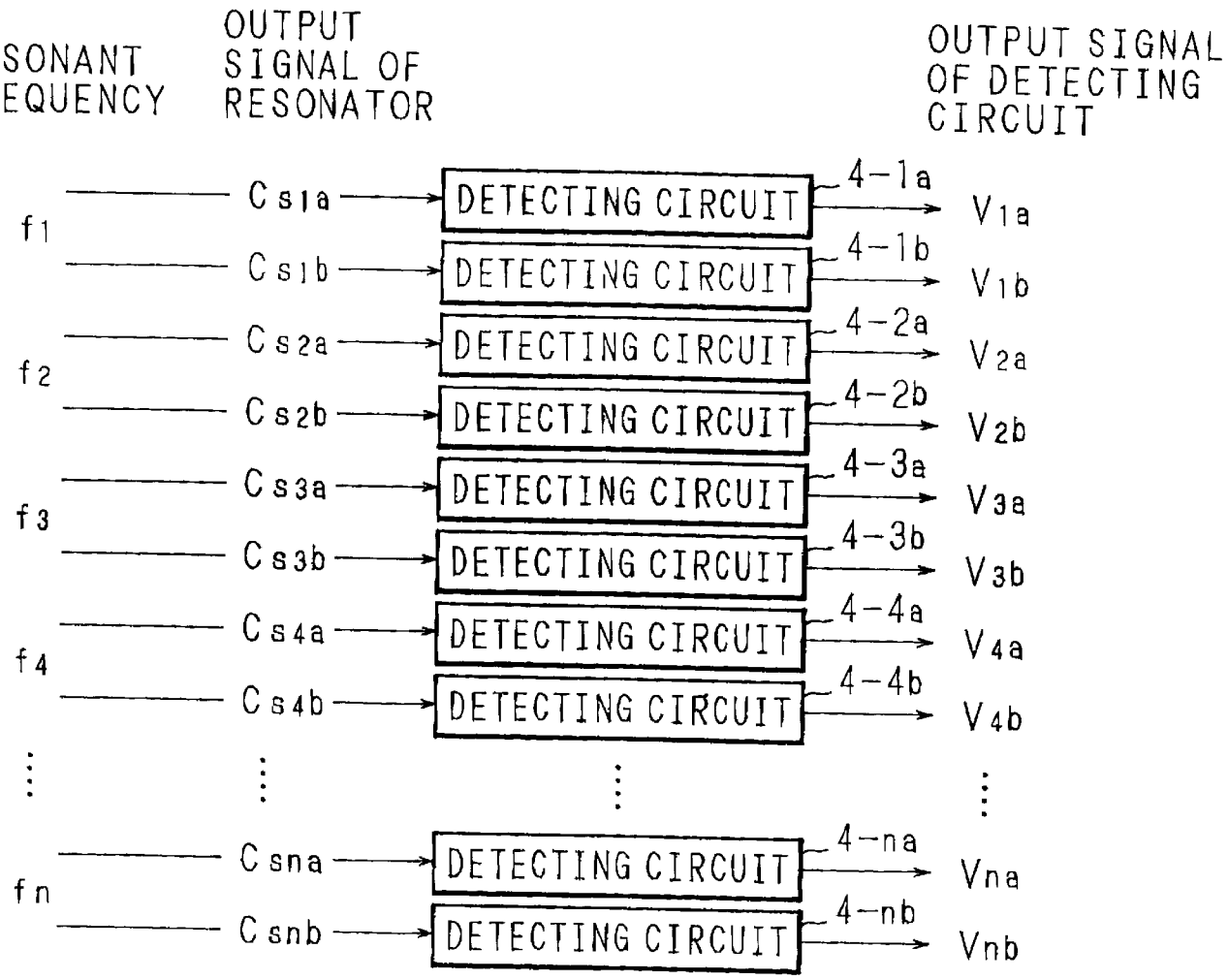
FIG. 7 is a diaphragm showing the relationship of each detecting circuit corresponding to a predetermined frequency.

FIG. 7 is a diagram showing the relationship of each detecting circuit 4 corresponding to the specific frequency. For example, when 2n number (in total) of resonators each being two are provided so as to selectively vibrate in response respectively to n types of resonant frequencies $f_1$, $f_2$, $f_3$, $f_4$, . . . , $f_n$, output signals of the 2n number $V_{1a}$, $V_{1b}$, $V_{2a}$, $V_{2a}$, $V_{2b}$, $V_{3a}$, $V_{3b}$, $V_{4a}$, $V_{4b}$, . . . , $V_{na}$, $V_{nb}$ corresponding to the resonant intensity for each of resonant frequencies can be obtained from each detecting circuit 4. In this embodiment, the detecting sensitivity becomes better as compared with a case where one detecting system only is provided, because two detecting systems are provided to one resonant frequency. For example, when the sound wave detector of this invention is used as a microphone for inputting speeches to recognize the speeches, the intensity of the frequency is obtained in accordance with the resonant intensity for each resonant frequency in the audible band and the speeches are recognized on the basis of the obtained analysis pattern.

In detecting only the intensity of the optionally selected frequency of the sound wave, only the output signal of the detecting circuit 4 corresponding to the necessary resonant frequency has to be obtained. For example, in detecting the intensity of the frequencies $f_1$ and $f_3$ in FIG. 7 is obtained, the necessary output singles $V_{1a}$, $V_{1b}$, $V_{3a}$, $V_{3b}$ are obtained and the unnecessary output signals $V_{2a}$, $V_{2b}$, $V_{4a}$, $V_{4b}$, . . . , $V_{na}$, $V_{nb}$ are not obtained by cutting off the outputs of the other output circuits 4-2*a*, 4-2*b*, 4-4*a*, 4-1*b*, . . . , 4-n*a*, 4-n*b* not corresponded or by not providing in advance the detecting circuits 4-2*a*, 4-2*b*, 4-4*a*, 4-4*b*, . . . , 4-n*a*, 4-n*b*. As an ideal example of using such an acoustic sensor, there is a microphone for inputting abnormal sounds to detect abnormal sounds of one predetermined or a plurality of frequency.

(Second Embodiment)

Figure 8:
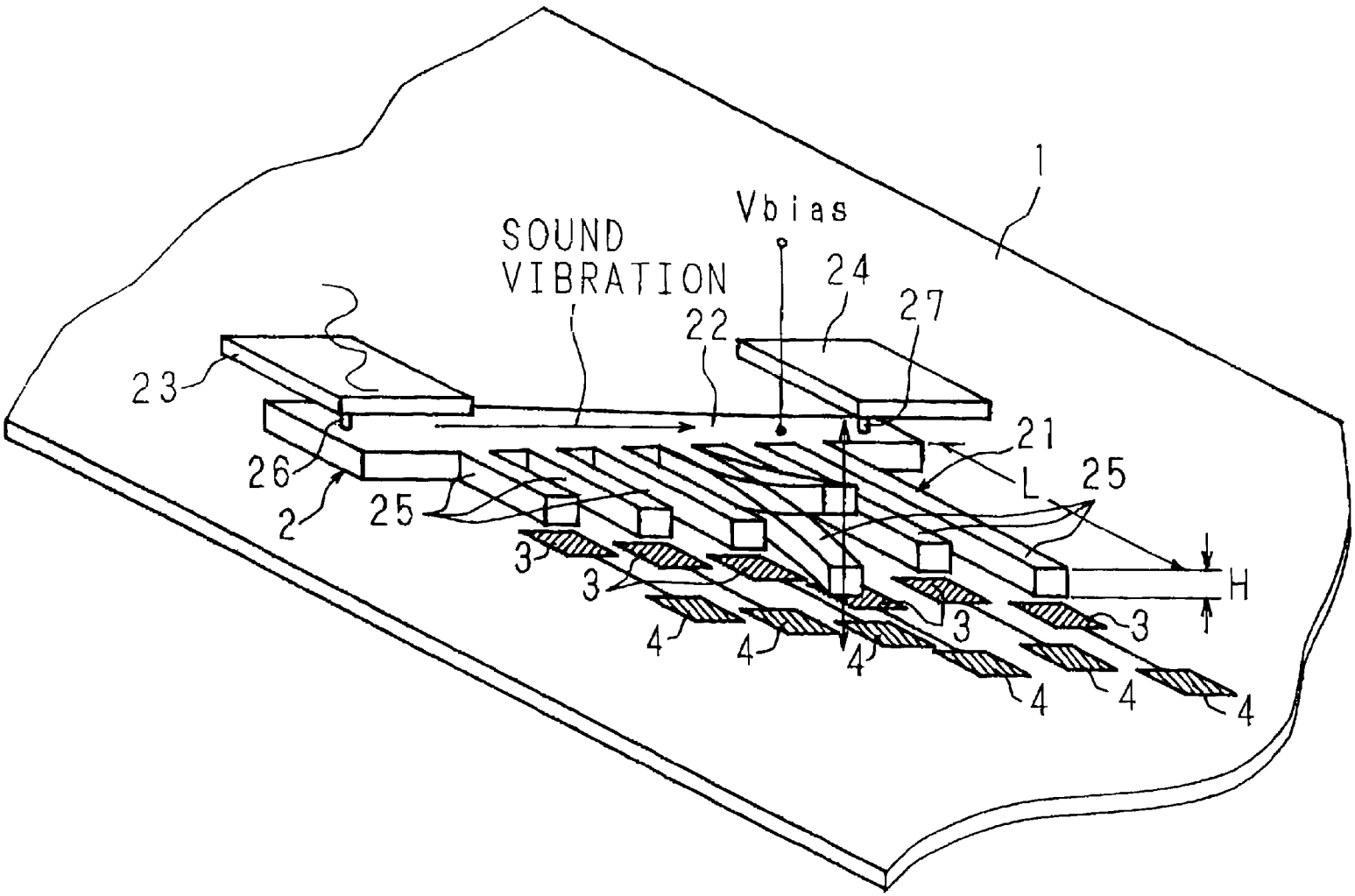
FIG. 8 is a view showing a second embodiment of the sound wave detector of this invention.

FIG. 8 is a view showing a second embodiment of a sound wave detector of this invention. In the second embodiment, a plurality of resonators 25 adjusted in length to resonate at the predetermined frequencies are provided only on the single side of the retaining rod 22, not that a pair of resonators 25 having the same resonant frequency on two sides of the retaining rod 22 as in the first embodiment. Characteristics of the resonant frequency of each resonator 25 is similar to those of the first embodiment. Namely, as in the first embodiment, the thickness H of all the resonators 25 is made constant. The length L becomes sequentially longer towards the right side (second diaphragm 24 side) from the left side (first diaphragm 23 side), and the resonant frequency where each resonator 25 resonates naturally is set to the low frequency from the high frequency as the resonator goes to the right side from the left side. In this embodiment, a resonator 25 corresponding to each higher resonant frequency is positioned on the side of the first diaphragm 23 and a resonator 25 corresponding to each lower resonant frequency is positioned on the side of the second diaphragm 24, namely, a resonator 25 is positioned so that a resonant frequency tends to rise toward the first diaphragm 23 side, or toward the inputting terminal of the vibration. As another configuration and detecting operation in the second embodiment is similar to those of the first embodiment, the description is omitted.

In the second embodiment, since the resonators 25 are provided only on the single side of the retaining rod 22, a sound wave detector which is simplified in configuration and lower in cost as compared with the first embodiment.

(Third Embodiment)

Figure 9:
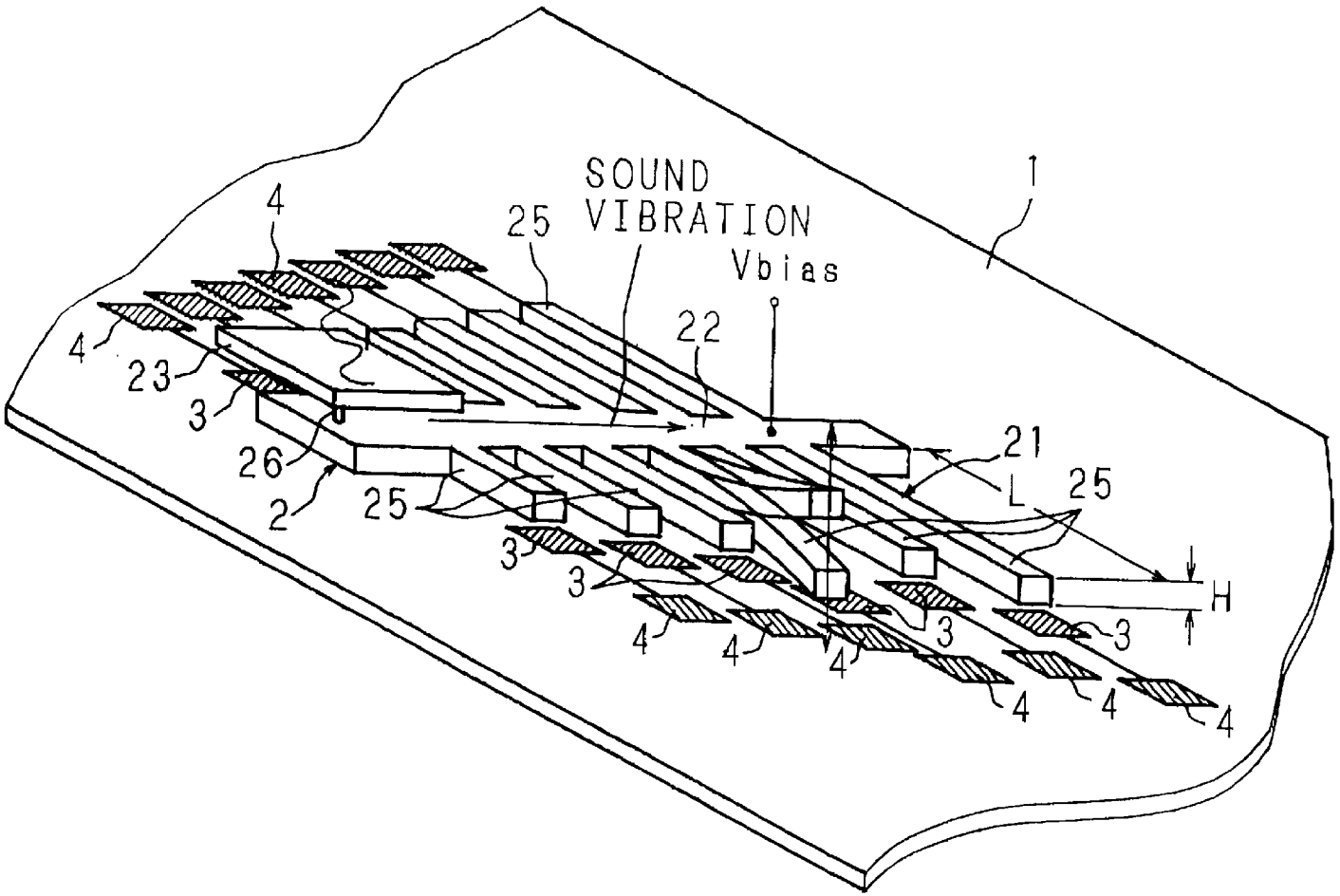
FIG. 9 is a view showing a third embodiment of the sound wave detector of this invention.
Figure 10:
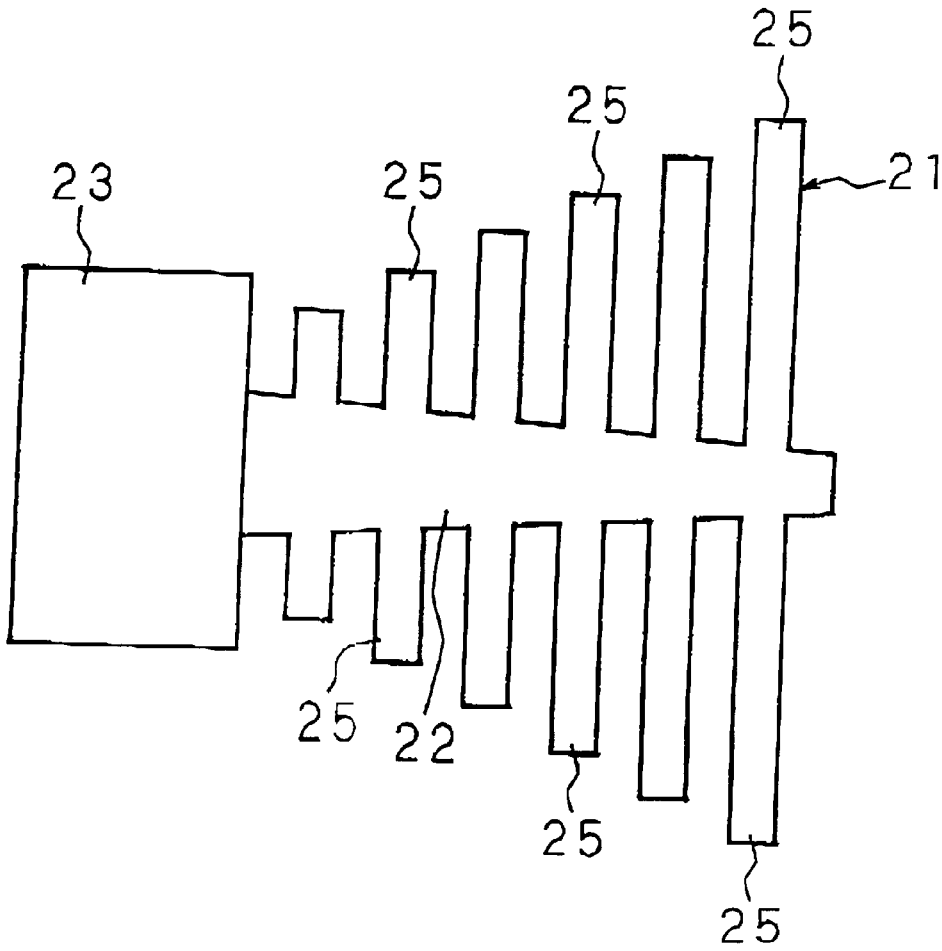
FIG. 10 is a plane view of a sensor main body of the sound wave detector (the third embodiment) of this invention.

FIG. 9 is a view showing a third embodiment of a sound wave detector of this invention. FIG. 10 is a plan view of a sensor main body in the third embodiment. In the third embodiment, another end of the retaining rod 22 is completely fixed to the silicon substrate 1 of semiconductor in a configuration where the second diaphragm 24 and the propagating portion 27 are removed from the construction of the first embodiment. When the different of the resonant frequencies of the adjacent resonators 25 is not large, or the intensity of the sound waves received in the first diaphragm 23 is not large, it is considered that most of the frequency components are absorbed in the resonators 25 so that they are hardly propagated to the another end of the retaining rod 22. Even when the frequency components of the inputted sound waves are within the set frequency band of the sound wave detector of this invention, most of the frequency components are absorbed in the resonators 25. In such a case, the detecting accuracy and sensitivity remains almost unchanged even if the influences of the noises caused by reflection are neglected. The third embodiment is a sound wave detector suitable for such a situation.

The characteristics of the resonant frequency of each resonator 25 is similar to those of the first embodiment. Namely, as in the fist embodiment, the thickness H of all the resonators 25 is made constant, the length L becomes sequentially longer as it goes from the left side (the side of the first diaphragm 23) to the right side (the far side from the first diaphragm 23 or opposite side of the first diaphragm 23). As it goes to the right side from the left side, each resonator 25 sets the naturally vibrating resonant frequency to the low frequency from the high frequency. In this embodiment, a resonator 25 corresponding to each higher resonant frequency is positioned on the side of the first diaphragm 23, namely, a resonator 25 is positioned so that a resonant frequency tends to rise toward the first diaphragm side, or toward the inputting terminal of the vibration. Since another configuration and the detecting operation in the third embodiment are similar to those of the first embodiment, the description will be described.

In the third embodiment, the configuration can be made smaller in size and lower in cost as compared with the first embodiment, because the second diaphragm 24 is not provided.

The measured results of the concretely characteristics of the above described first embodiment (configuration where the second diaphragm 24 is provided opposite to the input side of the retaining rod 22) and the above described third embodiment (configuration where the end portion opposite to the input side of the retaining rod 22 is completely fixed to the silicon substrate 1 of semiconductor) will be described hereinafter. The design size of the single crystal silicon made sensor main body 2 (first, second diaphragms 23 and 24, a plurality of resonators 25, and retaining rod 22) in the embodiments are as follows. But in the third embodiment, the second diaphragm 24 does not exist.

| | |
|---|---|
| Size of first, second diaphragms 23, 24 | 3000 × 4000 (μm × μm) |
| Number of resonators 25 | 15 |
| Length (L) of eachresonator 25 | 1400–2150 (μm) |
| Width of each resonator 25 | 80 (μm) |
| Thickness (H) of each resonator 25 | 10 (μm) |
| Width of retaining rod 22 | 100–237 (μm) |
| Resonator 25 pitch in retaining rod 22 | 200 (μm) |
| Thickness of retaining rod 22 | 10 (μm) |

Figure 11:
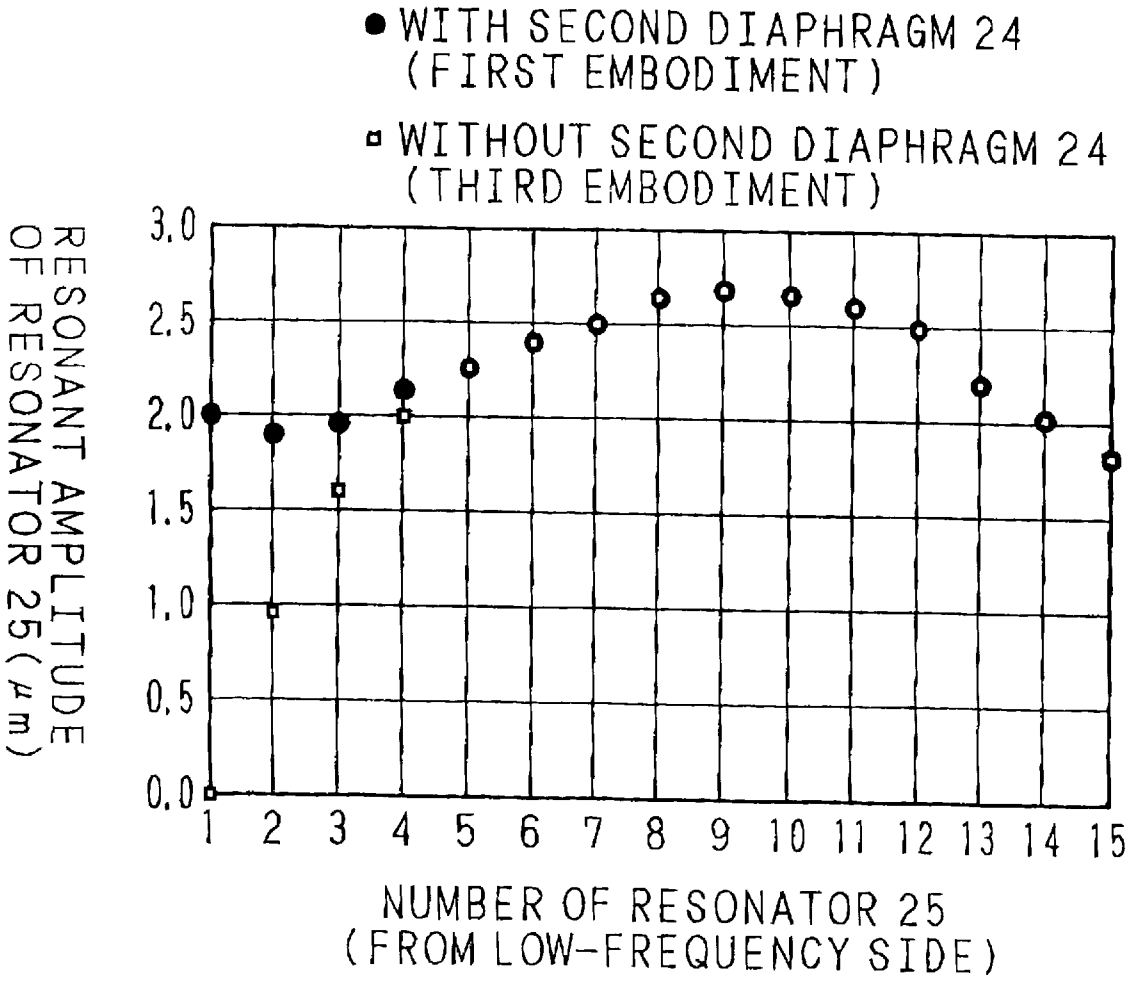
FIG. 11 is a graph showing the measured results of the resonant amplitude of each resonator.

FIG. 11 is a graph showing the results, analyzed by Finite Element Method, of the amplitude at the resonant time in each resonator 25 when the sound waves of the sine waves of the amplitude 1.0 Pa were inputted with the frequency of 3 through 6 kHz with respect to the first embodiment and the third embodiment of such a configuration. In FIG. 11, an abscissa shows the number (numbered sequentially from the low frequency side) of each resonator 25, an ordinate shows the resonant amplitude (μm) in each resonator 25, ● shows characteristics in the first embodiment, and □ shows the characteristics in the third embodiment.

In the third embodiment, it is found out as compared with the first embodiment that the resonant amplitude in several resonators 25 on the low frequency side near the stationary end becomes smaller. This is due to a fact that the end portion opposite side to the input side of the retaining rod 22 is completely fixed to the silicon substrate 1 of semiconductor and the acoustic energy is not propagated up to several resonators 25 on the low frequency side with better efficiency.

Figure 12:
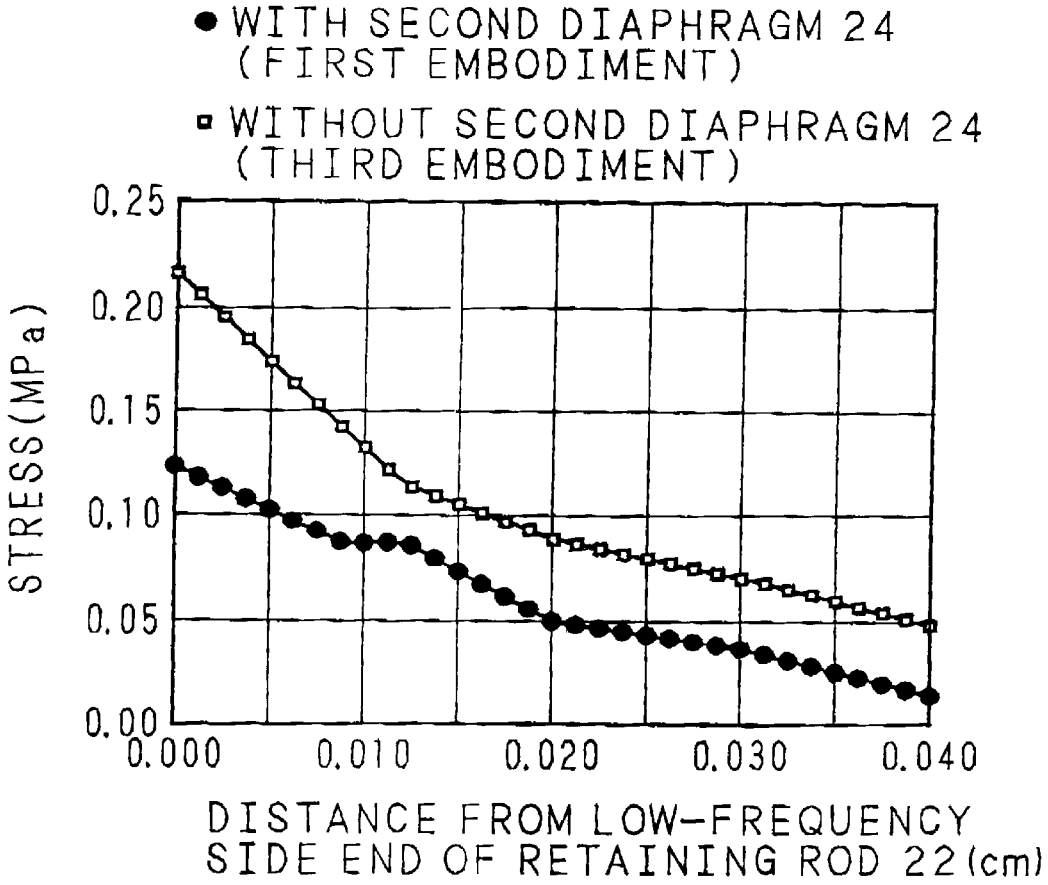
FIG. 12 is a graph showing the measured results of stress in a retaining rod.

FIG. 12 is a graph showing the results, analyzed by Finite Element Method, of the stress by the self-weight about the first embodiment and the third embodiment composed as described hereinabove. In FIG. 12, an abscissa shows the distance (cm) from the low frequency side end of the retaining rod 22, an ordinate shows the stress (MPa) by selt-weight, ● shows the characteristics in the first embodiment, and □ shows the characteristics in the third embodiment. In the first embodiment, it is found out that the local stress is alleviated as compared with the third embodiment.

(Fourth embodiment)

A fourth embodiment wherein the resonant frequency in each resonator 25 is distributed linearly in the mel scale which is a psychological attribute representing the pitch of the sound as shown in musical scale will be described hereinafter. Although the basic configuration of the sound wave detector of the fourth embodiment is similar to that of the first, second or third embodiment, in the fourth embodiment, the resonant frequency in each resonator 25 is distributed linearly in the mel scale, instead of the mathematically linear scale.

$$f_1[\text{mel}]=\alpha f_2[\text{mel}]= \ldots \alpha^{n-1} f_n[\text{mel}]$$

is set, instead of $$f_1[\text{Hz}]=\alpha f_2[\text{Hz}]= \ldots \alpha^{n-1} f_n[\text{Hz}]$$

wherein the resonant frequency in each resonator 25 is made $f_1, f_2, f_3, \ldots, f_n$.

The $\alpha$ is a coefficient which can be optionally set.

Figure 1:
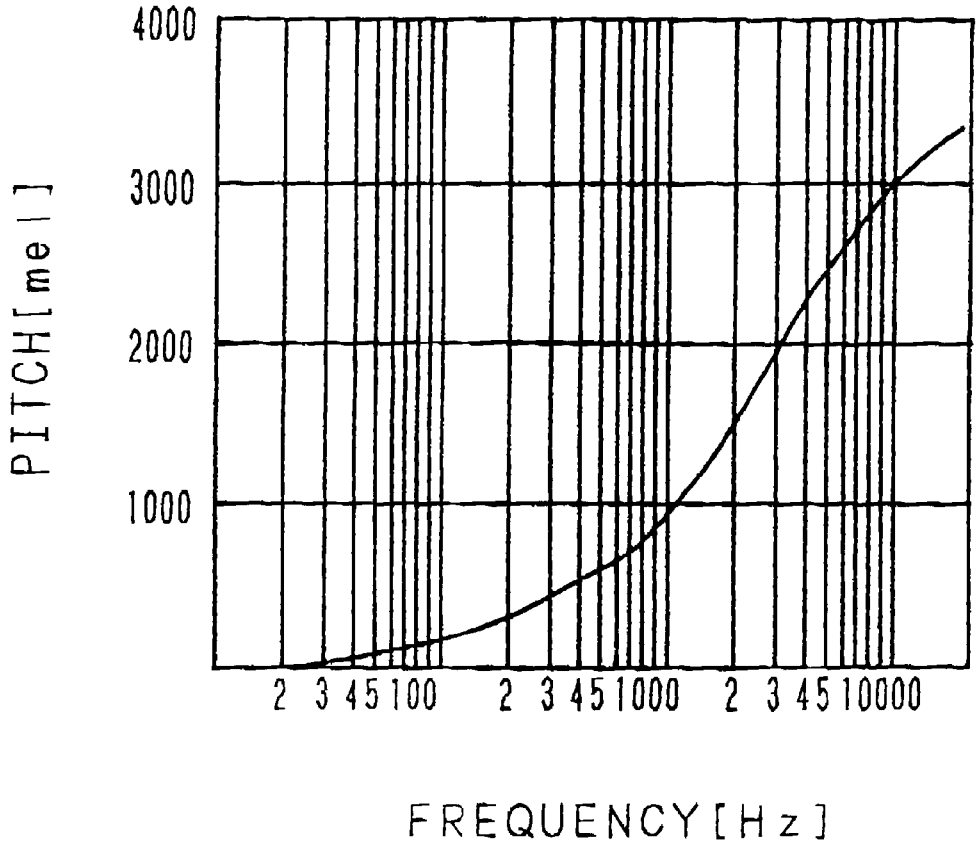
FIG. 1 PRIOR ART
FIG. 1 is a graph showing the relationship between the actual frequency and the mel scale value.

The resonant frequency of each resonator 25 is determined in the (4) equation. Also, as the correspondence between the actual vibration frequency and the mel scale is determined based on the above described (1) equation and FIG. 1 as described above, the optical resonant frequency in the mel scale can be assigned easily to each resonator 25. In the present embodiment, the resonant frequency in accordance with the frequency which becomes equal in distance in the mel scale, can be obtained with the thickness H of all the resonators 25 being constant and the length L being made different.

Conventionally although a series of processing of conducting Fast Fourier transform on the spectra of the acoustic signal and converting into the mel scale was conducted with software on the computer, the calculation amount was immense and the calculating load became large in this case. The physical value corresponding to the acoustic signal spectra can be detected with extreme simplicity and ease in the meal scale, because in the fourth embodiment, the resonant frequency of each resonator 25 is distributed in the mel scale and the vibration in each resonator 25 set in the mel scale specification is detected. As the result, octave sounds, half tones and so on which are audible to the human beings can be selectively recognized at real time, and speeches can be recognized in an approximated condition by the human audition. Thus, it is possible to extract with efficiency the characteristics of the speech at the speech recognition, thereby making it possible to manufacture a microphone having the frequency characteristics set to the human audition. Since the time change in pitch sounds of the octave sounds, half tones and so on can be judged more correctly, a microphone for inputting speeches can be constructed, which is not only efficient in speech recognition and abnormal sound detection, but also superior in discrimination property to intoned speeches such as reading, poetry and so on, and sounds having scales such as music pieces.

(Fifth Embodiment)

A fifth embodiment will be described wherein the resonant frequency in each resonator 25 is distributed linearly in the Bark scale which is a psychological attribute representing the loudness of the sound. The basic configuration of the sound wave detector of this fifth embodiment is similar to that of the above described first, second or third embodiment. In the fifth embodiment, the resonant frequency in each resonator 25 is distributed in the Bark scale, instead of in the mathematically linear scale, and the band width of the resonant frequency in each resonator 25 is adapted to become a critical band width.

The resonant frequency of each resonator 25 is determined in accordance with the corresponding relationship between the Bark scale and the actual frequency shown in FIG. 2. Although the resonant frequency of each resonator 25 is determined in the (4) equation, in this embodiment the thickness H of all the resonators 25 is constant and the length L is made different so that the optional resonant frequency in the Bark scale is assigned to each resonator 25.

The band width of the resonant frequency of each resonator 25 depends upon the interaction with respect to the adjacent resonator 25 in a process where vibration energy is transmitted in the resonant unit 21. Namely, the hand width is determined by the change ratio of the resonant frequency of the adjacent resonator 25, the design value in such a configuration as the distance so far as the adjacent resonator 25, the viscosity of gas between the adjacent resonators 25, and so on. In this embodiment, the band width of the resonant frequency of each resonator 25 is controlled by changing the distance between the adjacent resonators 25. The correspondence between the actual vibration frequency and the Bark scale, and the cut off frequency for deciding the critical band width are determined in accordance with the (2) and (3) equations and FIG. 2 so that the design specification of each resonator 25 can be decided easily.

Figure 13:
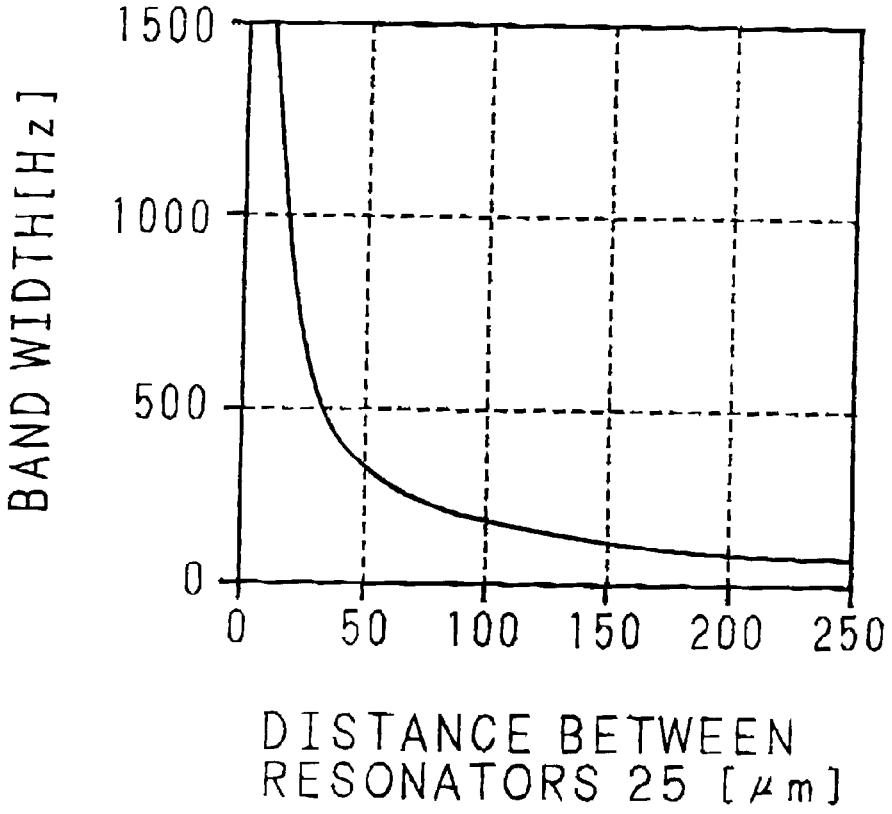
FIG. 13 is a graph showing the relationship of the distance between the resonators, and the band width.
Figure 14:
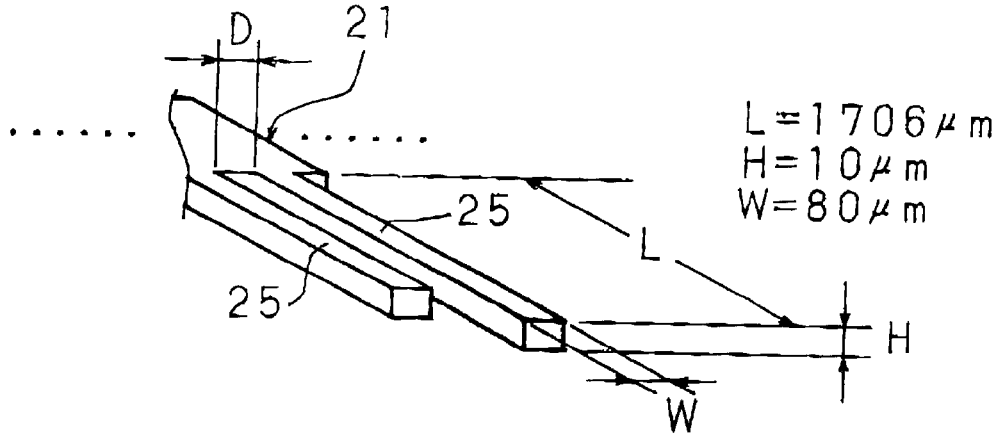
FIG. 14 is a view showing the relationship between the length, thickness, width and distance of the resonators in the sound wave detector of this invention.

FIG. 13 is a graph showing change in the band width (ordinate) in the case where the distance D (abscissa) changes up to the adjacent resonator 25 in a single crystal silicon made resonator 25 with the resonant frequency being 3 kHz. FIG. 14 is a view showing the relationship between the length L, thickness H, width W and distance D in the resonator 25. The design value of the resonator 25 is length L=1706 $\mu$m, thickness H=10 $\mu$m, width W=80 82 m with the gas between the adjacent resonators 25 being air. By adjusting the distance D between the adjacent resonators 25, it is understood from FIG. 13 that the desired hand width can be set. Considering this fact, in this embodiment the distance D between the adjacent resonators 25 is decided so that the band width of each resonator 25 may become a critical band width shown in FIG. 2.

Conventionally the spectra of the acoustic signal was analyzed in frequency spectra by critical band width filter groups and a series of processing for converting into the Bark scale was conducted with software on the computer. In this case, the calculation amount became immense and the calculating load became large. The physical value corresponding to the spectra of the acoustic signal can be detected in the Bark scale with the critical band width, because in the fifth embodiment, the resonant frequency of each resonator 25 is distributed in the Bark scale, and the band width of each resonant frequency becomes the critical band width. As the result, the speech can be recognized in a condition of the more approximated human audition and it is possible to extract the characteristics of the speech with good efficiency at the speech recognition. Also, the frequency characteristics and band width set to the human audition can be provided and the acoustic signal hidden in noises becomes easier to select, so that the judging ratio of the speech recognition rises in a situation where noises are more. Furthermore, a sensor more similar to the human audition can be provided.

(Sixth Embodiment)

Even in the fourth embodiment where the resonant frequency in each resonator 25 is distributed linearly in the mel scale, it is effective that the band width of the resonant frequency in each resonator 25 becomes a critical band width as in the fifth embodiment.

Although the band of the predetermined resonant frequency is made a range of 15 Hz through 20 kHz in a plurality of resonators 25 in the above described embodiments, this is an example and it is needless to say that other frequency range can be used. Since the waves are sound waves, the frequency range is several Hz through 50 kHz (up to 100 kHz at maximum).

In the sound wave detector of this invention as described above, the sound waves are mechanically analyze for each frequency band before they are converted into electrical signals, whereby the conventional electric filtering processing using a software becomes unnecessary make the processing speed faster. The detector can be easily made on the semiconductor substrate. The occupying area can be made smaller as compared with the conventional system, so as to reduce the cost. Furthermore, since the sound intensity can be detected for each of the desired frequencies, the acoustic spectra can be obtained at real time without conducting the analysis processing with software on the computer.

Although the sound wave detector with the vibration waves being sound waves is described as an example of this invention, it is needless to say that the frequency spectra of the vibration waves can be analyzed in the same configuration even in the vibration waves except for the sound waves.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of metes and bounds thereof are therefore intended to be embraced by the claims.

What is claimed is:

1. A vibration wave detector, comprising:

a first diaphragm for receiving vibration waves to be propagated in a medium;

a resonant unit having a plurality of cantilever resonators each having varying length as to resonate at an individual predetermined frequency;

a retaining rod for retaining the resonant unit;

a second diaphragm positioned on the opposite side of the first diaphragm with respect to the retaining rod; and a vibration intensity detector for detecting the vibration intensity, for each predetermined frequency, of each of the resonators.

2. The vibration wave detector of claim 1, wherein the width of the retaining rod becomes narrower as it becomes farther away from the first diaphragm.

3. The vibration wave detector of claim 1, wherein the first diaphragm, the resonant unit, the retaining rod, the second diaphragm and the vibration intensity detector are composed on a semiconductor substrate.

4. The vibration wave detector of claim 1, further comprising:

a converting apparatus for converting the vibration intensity into electric signals for each predetermined frequency detected by the vibration intensity detector;

an integrating apparatus for integrating the converted electric signals during an optionally set time period; and an outputting apparatus for outputting, for each predetermined frequency, the results integrated by the integrating apparatus after the optionally set time period has elapsed.

5. The vibration wave detector of claim 4, wherein the first diaphragm, the resonant unit, the retaining rod, the second diaphragm, the vibration intensity detector, the converting apparatus, the integrating apparatus and the outputting apparatus are composed on a semiconductor substrate.

6. The vibration wave detector of claim 1, wherein the plurality of resonators are positioned so that resonant frequencies become sequentially lower to the second diaphragm side from the first diaphragm side.

7. The vibration wave detector of claim 6, wherein the width of the retaining rod becomes narrower as it becomes farther away from the first diaphragm.

8. The vibration wave detector of claim 1, wherein the plurality of resonators are positioned so that resonant frequencies tend to rise toward the inputting terminal of vibration.

9. The vibration wave detector of claim 1, wherein the vibration waves are sound waves.

10. The vibration wave detector of claim 9, wherein the resonant frequencies in the plurality of resonators are set to be distributed in a mel scale.

11. The vibration wave detector of claim 9, wherein the resonant frequencies in the plurality of resonators are set to be distributed in a mel scale, and the hand width corresponding to each resonant frequency is a critical hand width.

12. The vibration wave detector of claim 9, wherein the resonant frequencies in the plurality of resonators are set to be distributed in a Bark scale.

13. The vibration wave detector of claim 9, wherein the resonant frequencies in the plurality of resonators are set to be distributed in a Bark scale, and the band width corresponding to each resonant frequency is a critical band width.

14. A vibration wave detector, comprising:

a diaphragm for receiving vibration waves to be propagated in a medium;

a resonant unit having a plurality of cantilever resonators each having varying length as to resonate at an individual predetermined frequency;

a retaining rod for retaining the resonant unit; and a vibration intensity detector for detecting the vibration intensity, for each predetermined frequency, of each of the resonators;

wherein the plurality of resonators are positioned so that resonant frequencies become sequentially lower to the far position side of the diaphragm from the near position side thereof.

15. The vibration wave detector of claim 14, wherein the width of the retaining rod becomes narrower as it becomes farther away from the diaphragm.

16. The vibration wave detector of claim 14, wherein the diaphragm, the resonant unit, the retaining rod and the vibration intensity detector are composed on a semiconductor substrate.

17. The vibration wave detector of claim 14, further comprising:

a converting apparatus for converting the vibration intensity into electric signals for each predetermined frequency detected by the vibration intensity detector;

an integrating apparatus for integrating the converted electric signals during an optionally set time period; and an outputting apparatus for outputting, for each predetermined frequency, the results integrated by the integrating apparatus after the optionally set time period has elapsed.

18. The vibration wave detector of claim 17, wherein the diaphragm, the resonant unit, the retaining rod, the vibration intensity detector, the converting apparatus, the integrating apparatus and the outputting apparatus are composed on a semiconductor substrate.

19. The vibration wave detector of claim 14, wherein the vibration waves are sound waves.

20. The vibration wave detector of claim 19, wherein the resonant frequencies in the plurality of resonators are set to be distributed in a mel scale.

21. The vibration wave detector of claim 19, wherein the resonant frequencies in the plurality of resonators are set to be distributed in a mel scale, and the band width corresponding to each resonant frequency is a critical band width.

22. The vibration wave detector of claim 19, wherein the resonant frequencies in the plurality of resonators are set to be distributed in a Bark scale.

23. The vibration wave detector of claim 19, wherein the resonant frequencies in the plurality of resonators are set to be distributed in a Bark scale, and the band width corresponding to each resonant frequency is a critical band width.

* * * * *